US011168496B2

(12) United States Patent
Jean et al.

(10) Patent No.: US 11,168,496 B2
(45) Date of Patent: Nov. 9, 2021

(54) LATCHING DEVICE AND SLIDING DOOR USING SAME

(71) Applicant: Wen-Fong Jean, Taoyuan (TW)

(72) Inventors: Wen-Fong Jean, Taoyuan (TW); Tai-Lien Huang, Taoyuan (TW); Sen-Hung Chen, Taoyuan (TW)

(73) Assignee: Wen-Fong Jean, Taoyuan (TW)

( * ) Notice: Subject to any disclaimer, the term of this patent is extended or adjusted under 35 U.S.C. 154(b) by 596 days.

(21) Appl. No.: 16/205,536

(22) Filed: Nov. 30, 2018

(65) Prior Publication Data

US 2020/0173197 A1 Jun. 4, 2020

(51) Int. Cl.
*E05B 65/08* (2006.01)
*E05C 3/06* (2006.01)
(Continued)

(52) U.S. Cl.
CPC ..... *E05B 65/08* (2013.01); *E05B 59/00* (2013.01); *E05C 3/06* (2013.01); *E05C 17/60* (2013.01);
(Continued)

(58) Field of Classification Search
CPC ..... E05B 59/00; E05B 65/08; E05B 65/0811; E05B 57/00; E05B 61/00; E05B 63/18; E05B 63/185; E05B 17/20; E05B 17/2007; E05B 17/2015; E05B 17/203; E05B 17/2034; E05B 17/208; E05B 70/95–10; E05B 70/107–1119/02; E05B 15/10; E05B 65/0025; E05B 65/0817; E05B 65/087; E05B 65/0835; E05B 65/0864; E05C 3/06; E05C 17/60; E05C 17/62; E05C 3/00;
(Continued)

(56) References Cited

U.S. PATENT DOCUMENTS 9,771,741 B2 * 9/2017 Sljivic ..... E05C 3/042
2003/0160463 A1 * 8/2003 Tonges ..... E05B 63/18 292/336.3
(Continued)

FOREIGN PATENT DOCUMENTS

CN 103132809 A * 6/2013 ..... E05B 63/0013
EP 2754795 A2 * 7/2014 ..... E05C 7/04
(Continued)

*Primary Examiner* — Kristina R Fulton
*Assistant Examiner* — Tal Saif
(74) *Attorney, Agent, or Firm* — Kirton McConkie; Evan R. Witt

(57) ABSTRACT

The present invention provides a latching device and a sliding door using the same. The latching device includes two displacement components and two latching components arranged on the main body of the sliding door. The two displacement components are connected to each other and respectively arranged to drive the two latching components to displace. The two displacement components are operated through the lateral side and the edge side of the sliding door, respectively. The user can latch or unlatch the sliding door by operations of displacing the at least two displacement components when the sliding door is in a closed state or a completely open state. In addition, when a concealed sliding door is fully opened and the two sides are both hidden in the walls, the sliding door can be latched or unlatched by operating the latching device through the edge side of the sliding door.

18 Claims, 15 Drawing Sheets

(51) Int. Cl.
*E05C 17/60* (2006.01)
*E05B 59/00* (2006.01)
*E06B 3/46* (2006.01)

(52) U.S. Cl.
CPC ..... *E06B 3/4636* (2013.01); *E05Y 2900/132* (2013.01)

(58) Field of Classification Search
CPC . E05C 3/004; E05C 3/008; E05C 3/02; E05C 3/10; E05C 3/30; E06B 3/4636; E06B 3/46; E05Y 2900/132; Y10T 292/0911; Y10T 292/0947; Y10T 292/0949; Y10T 292/1039; Y10T 292/1043; Y10T 292/1077; Y10T 292/108; Y10T 292/54; Y10T 292/564; Y10S 292/30; Y10S 292/31; Y10S 292/46; Y10S 292/63
See application file for complete search history.

(56) References Cited

U.S. PATENT DOCUMENTS

2012/0147550 A1* 6/2012 Takata ..... H02B 1/52 361/679.43
2015/0021932 A1* 1/2015 Horwood ..... E05B 63/185 292/224

FOREIGN PATENT DOCUMENTS

GB 2455777 B * 3/2013 ..... E05C 9/1875
KR 20170005268 A * 1/2017
SE 1050617 A1 * 6/2011

* cited by examiner

2

1

1

LATCHING DEVICE AND SLIDING DOOR USING SAME

FIELD OF THE INVENTION

The present invention relates to a latching device, and more particularly to a latching device and a sliding door using the same for fixing the sliding door in the open position and the closed position to improve the safety of the sliding door.

BACKGROUND OF THE INVENTION

A sliding door is a type of door which opens horizontally by sliding and is usually parallel to a wall. The sliding doors can be mounted either on top of a track below (i.e. Bottom-rolling-gear sliding door) or be suspended from a track above (i.e. Top-hung sliding doors) and some types disappeared in a wall when slid open. Advantages of the sliding door are that there is almost no room required to open the door. Therefore, the sliding door is commonly used as door in a transportation apparatus, such as a watercraft, a campervan, a train and a metro.

In a conventional sliding door in the transportation apparatus, the door may be locked by a simple hook mounted in the leading edge of the door. The hook is pivotally connected by means of a handle to engage with the strike plate in the door frame. However, the latching device in the sliding door is aimed at preventing the doors from sliding merely when sliding door is in the closed position. The latching device of the conventional sliding door fails to provide the function of fixing the sliding door in the open position. When the sliding door is free of being fixed in the open and the closed position, any movement of the transportation apparatus may drive the sliding door to slide. Under this circumstance, the people may be injured and the door will be damaged easily.

Therefore, there is a need of providing a latching device and a sliding door using the same to address the above-mentioned issues as using the conventional latching method. The latching device is capable of fixing the sliding door in the open position and the closed position so as to improve the safety of the sliding door.

SUMMARY OF THE INVENTION

An object of the present invention is to provide a latching device and a sliding door using the same. The latching device includes at least two latching members, which can be latched in latching slots disposed in a doorjamb and a sidewall of the sliding door along different directions, respectively. Thus, no matter when the sliding main body is in a closed position or in an open position, the latching device can be utilized to latch the sliding door, so as to improve the safety of the sliding door.

Another object of the present invention is to provide a latching device and a sliding door using the same. The latching device includes at least two latching members, which are correspondingly operated through at least two displacement members connected to each other. Thus, the user can simply operate with one hand to achieve the function of fixing the sliding main body in the closed position or the open position.

Other object of the present invention is to provide a latching device and a sliding door using the same. The latching device includes at least two latching members, which are disposed on the sliding main body of the sliding door and can be operated from two opposite sides of the sliding door. Moreover, the latching device is correspondingly operated through at least two displacement members connected to each other. In addition to fixing the sliding door in the open position of the sliding door, the latching device can be operated through the displacement component disposed on the edge surface of the sliding main body to unlatch the sliding door. Therefore, the latching device of the present disclosure can be further implemented in a concealed sliding door. When the concealed sliding door is fully opened and the two opposite sides of the sliding main body are both hidden in the walls, the sliding door can be latched automatically. Moreover, the latched sliding main body can be unlatched by operating the latching device through the edge surface of the sliding door. It benefits of effectively improving the safety and practicality of the sliding door. It also avoids the unexpected switching action caused by shaking.

In accordance with an aspect of the present invention, it provides a latching device for a sliding door. The latching device for a sliding door includes a main body, a fixed frame, a first displacement member, a first latching member, a second displacement member and a second latching member. The main body includes an edge surface, at least one lateral surface and an accommodation slot. The accommodation slot is disposed and adjacent to the edge surface and the at least one lateral surface, the edge surface is aligned to a first latching slot, and the at least one lateral surface is aligned to a second latching slot. The fixed frame is disposed on the main body and received within the accommodation slot. The fixed frame includes a first side, a second side and a limitation window, the first side and the second side are opposite to each other, and the first side faces to the edge surface. The first displacement member is received within the accommodation slot, disposed on the first side of the fixed frame and slid between a first position and a second position along a first axial direction. The first displacement member includes at least one through opening and at least one guiding groove. The first latching member is pivotally connected to the fixed frame and includes a guiding column, wherein at least portion of the guiding column is received within the guiding groove. When the first displacement member is slid to the first position, the guiding column is guided by the guiding groove to rotate the first latching member and at least portion of the first latching member runs through the at least one through opening and protrudes from the edge surface to make the first latching member and the first latching slot be engaged with each other. When the first displacement member is slid to the second position, the guiding column is guided by the guiding groove to rotate the first latching member and the first latching member is received within the at least one through opening. The second displacement member is received within the accommodation slot and adjacent to the first displacement member. The second displacement member is disposed on the first side of the fixed frame and slid between a third position and a fourth position along the first axial direction, and the second displacement member includes a limitation portion aligned with the limitation window. The second latching member is pivotally connected to the fixed frame and comprises a limitation end running through the limitation window and engaged with the limitation portion. When the second displacement member is slid to the third position, the limitation portion drives the limitation end to rotate the second latching member to be received within the accommodation slot. When the second displacement member is slid to the fourth position, the limitation portion drives the limitation end to rotate the second latching member to protrude at least portion of the second latching member from the at least one lateral surface to make the second latching member and the second latching slot be engaged with each other.

In accordance with another aspect of the present invention, it provides a sliding door. The sliding door includes a door frame, a sliding main body and a latching device. The door frame includes at least one doorjamb and at least one sidewall. The at least one doorjamb includes a first latching slot and the at least one sidewall includes a second latching slot. The sliding main body is slidably disposed on the door frame and includes an edge surface, at least one lateral surface and an accommodation slot. The accommodation slot is disposed and adjacent to the edge surface and the at least one lateral surface, the edge surface faces to the at least one doorjamb and is aligned to the first latching slot, and the at least one lateral surface is configured to slide along the at least one lateral surface and is aligned to the second latching slot. The latching device is embedded within the accommodation slot of the sliding main body. The latching device includes a fixed frame, a first displacement member, a first latching member, a second displacement member and a second latching member. The fixed frame is disposed on the sliding main body and received within the accommodation slot. The fixed frame includes a first side, a second side and a limitation window, the first side and the second side are opposite to each other, and the first side faces to the edge surface. The first displacement member is received within the accommodation slot, disposed on the first side of the fixed frame and slid between a first position and a second position along a first axial direction. The first displacement member includes at least one through opening and at least one guiding groove. The first latching member is pivotally connected to the fixed frame and includes a guiding column, wherein at least portion of the guiding column is received within the guiding groove. When the first displacement member is slid to the first position, the guiding column is guided by the guiding groove to rotate the first latching member and at least portion of the first latching member runs through the at least one through opening and protrudes from the edge surface to make the first latching member and the first latching slot be engaged with each other. When the first displacement member is slid to the second position, the guiding column is guided by the guiding groove to rotate the first latching member and the first latching member is received within the at least one through opening. The second displacement member is received within the accommodation slot and adjacent to the first displacement member. The second displacement member is disposed on the first side of the fixed frame and slid between a third position and a fourth position along the first axial direction, and the second displacement member includes a limitation portion aligned with the limitation window. The second latching member is pivotally connected to the fixed frame and includes a limitation end running through the limitation window and engaged with the limitation portion. When the second displacement member is slid to the third position, the limitation portion drives the limitation end to rotate the second latching member to be received within the accommodation slot. When the second displacement member is slid to the fourth position, the limitation portion drives the limitation end to rotate the second latching member to protrude at least portion of the second latching member from the at least one lateral surface to make the second latching member and the second latching slot be engaged with each other.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
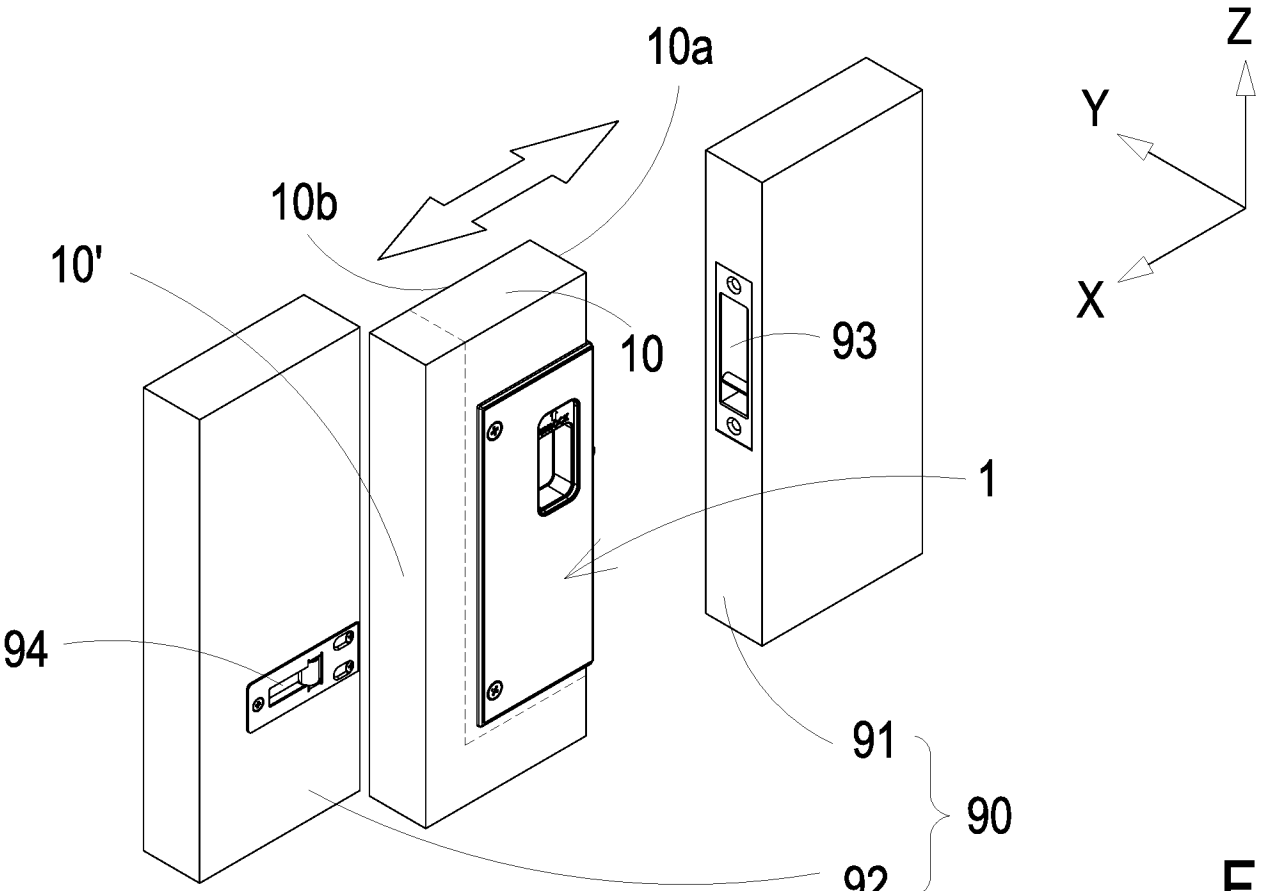
FIG. 1 is a perspective structural view illustrating a latching device and a sliding door using the same according to a first embodiment of the present disclosure.
Figure 2:
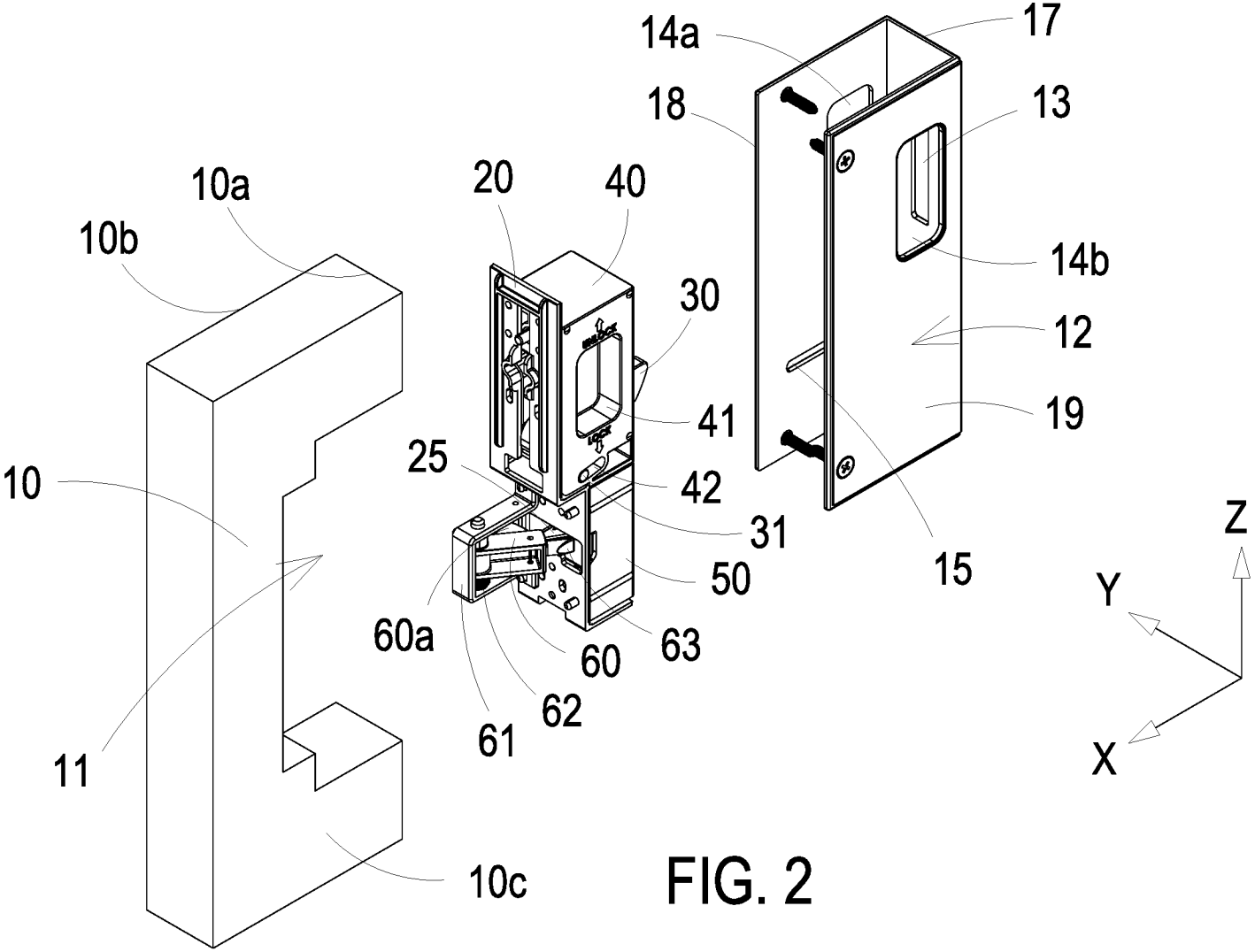
FIG. 2 is a partial exploded view illustrating the latching device according to the first embodiment of the present disclosure.
Figure 3:
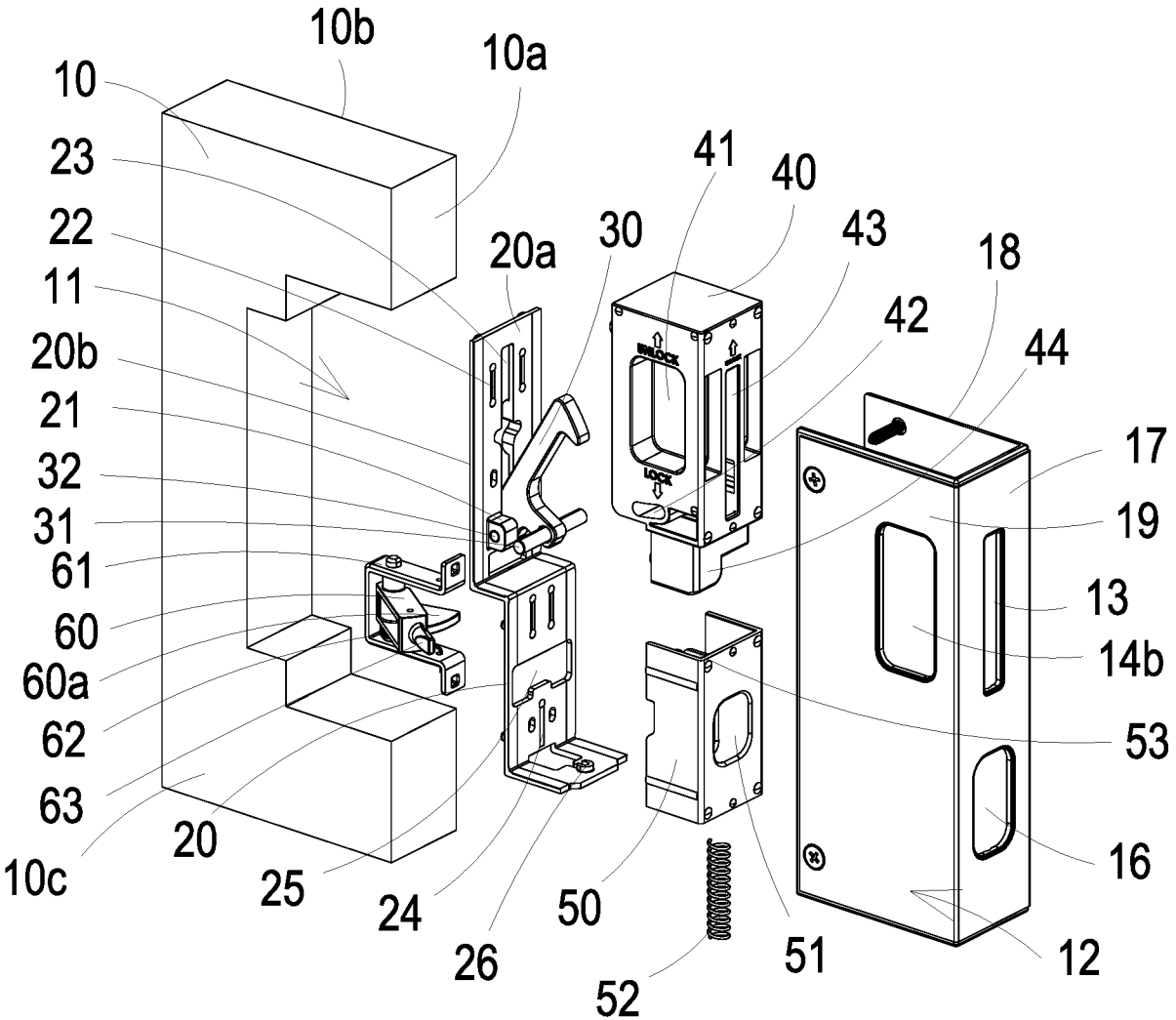
FIG. 3 is an explode view illustrating the latching device according to the first embodiment of the present disclosure.
Figure 4:
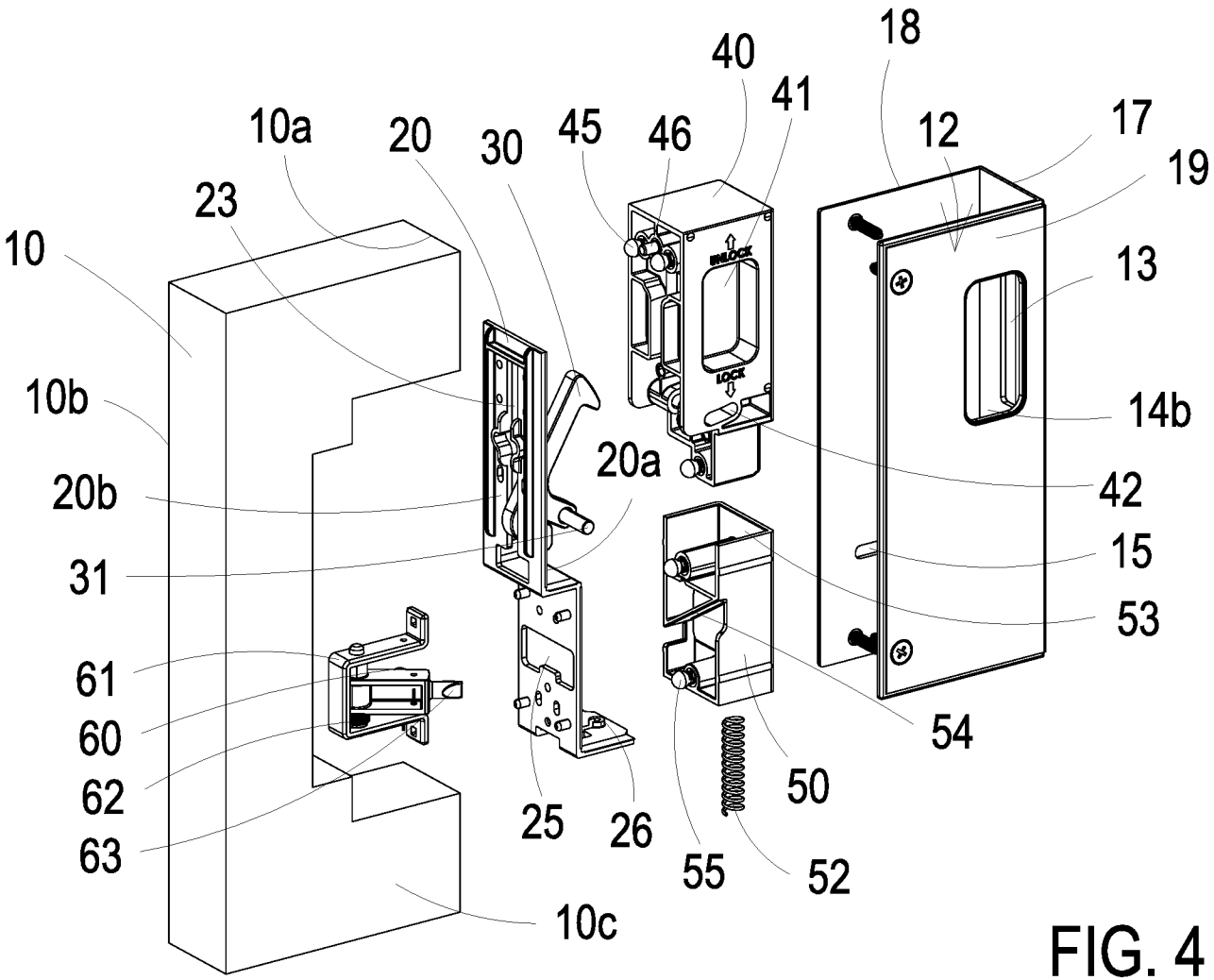
FIG. 4 is another explode view illustrating the latching device according to the first embodiment of the present disclosure and taken from a different perspective.

FIG. 1 is a perspective structural view illustrating a latching device and a sliding door using the same according to a first embodiment of the present disclosure. FIG. 2 is a partial exploded view illustrating the latching device according to the first embodiment of the present disclosure. FIG. 3 is an explode view illustrating the latching device according to the first embodiment of the present disclosure. FIG. 4 is another explode view illustrating the latching device according to the first embodiment of the present disclosure and taken from a different perspective. In the embodiment, the sliding door 2 includes a door frame 90, a sliding main body 10' and a latching device 1. The door frame 90 includes at least one doorjamb 91 and at least one sidewall 92. In the embodiment, the doorjamb 91 includes a first latching slot 93 and the sidewall 92 includes a second latching slot 94, which are utilized for latching the sliding main body 10'. The first latching slot 93 and the second latching slot 94 is disposed on different planes, respectively. In the embodiment, the sliding main body 10' is slidably disposed on the door frame 90. For example, the sliding main body 10' is slidably disposed on the door frame 90 through a bottom rail or an upper rail, so that the sliding main body 10' can slide horizontally relative to the door frame 90, for example, along the X-axis direction. Certainly, the manner of framing slidably the sliding main body 10' on the door frame 90 is not an essential features to limit the present disclosure, and not redundantly described herein. In the embodiment, the sliding main body 10' includes an edge surface 10*a*, a first lateral surface 10*b*, a second lateral surface 10*c* and an accommodation slot 11. The first lateral surface 10*b* and the second lateral surface 10*c* are opposite to each other. The accommodation slot 11 is disposed and adjacent to the edge surface 10*a*, the first lateral surface 10*b* and the second lateral surface 10*c*. The edge surface 10*a* faces to the at least one doorjamb 91 and is aligned to the first latching slot 93, and the first lateral surface 10*b* is configured to slide along the at least sidewall 92 and is aligned to the second latching slot 94. When a user pulls the sliding main body 10' to slide relative to the door frame 90 and make the sliding door 2 be in a closed state, the edge surface 10*a* of the sliding main body 10' tends to attach to the doorjamb 91, and the first lateral surface 10*b* of the sliding main body 10' slides for example along the reversed X-axis direction and is separated from the sidewall 92. Moreover, when a user pulls the sliding main body 10' to slide relative to the door frame 90 and make the sliding door 2 be in an open state, the edge surface 10*a* of the sliding main body 10' tends to move away from the doorjamb 91, and the first lateral surface 10*b* of the sliding main body 10' slides for example along the X-axis direction and is attached to the sidewall 92. In the embodiment, the first latching slot 93 disposed on the doorjamb 91 and the second latching slot 94 disposed on the sidewall 92 are constructed for example on two vertical planes, respectively, so as to achieve the purposes of latching the sliding door 2 in the closed state and the open state. In an embodiment, the doorjamb 91 can be embedded in a wall, or the sidewall 92 can be constructed by a structure with another embedded doorjamb. The present disclosure is not limited thereto and not redundantly described herein. In addition, the details of the various components and actions of the sliding door 2 will be described later.

As shown in FIGS. 1 to 4, in the embodiment, the latching device 1 is embedded within the accommodation slot 11 of the sliding main body 10'. Namely, the sliding main body 10' of the sliding door 2 is further configured to constitute a main body 10 of the latching device 1. The following descriptions will take the main body 10 for illustration. In the embodiment, the latching device 1 includes the main body 10, a fixed frame 20, a first displacement member 40, a first latching member 30, a second displacement member 50 and a second latching member 60. The main body 10 includes an edge surface 10*a*, a first lateral surface 10*b*, a second lateral surface 10*c* and an accommodation slot 11. The first lateral surface 10*b* and the second lateral surface 10*c* are opposite to each other. The accommodation slot 11 is disposed and adjacent to the edge surface 10*a*, the first lateral surface 10*b* and the second lateral surface 10*c*. The edge surface 10*a* faces to the doorjamb 91 and is aligned to the first latching slot 93 on the door jamb 91. The first lateral surface 10*b* is configured to slide along the sidewall 92 and aligned to the second latching slot 94 on the sidewall 92. The fixed frame 20 is disposed on the main body 10 and received within the accommodation slot 11. The fixed frame 20 includes a first side 20*a*, a second side 20*b* and a limitation window 25. The first side 20*a* and the second side 20*b* are opposite to each other. The first side 20*a* faces to the edge surface 10*a*. The first displacement member 40 is received within the accommodation slot 11, disposed on the first side 20*a* of the fixed frame 20 and slid between a first position and a second position along a first axial direction, for example the vertical Z-axis direction. Moreover, the first displacement member 40 includes at least one through opening 43 and at least one guiding groove 42. The first latching member 30 is pivotally connected to the fixed frame 20 and includes a guiding column 31, wherein at least portion of the guiding column 31 is received within the guiding groove 42. In the embodiment, the first latching member 30 is pivotally connected to a pivoting portion of the fixed frame 20 through a rotation shaft 32, so that the first latching member 30 is allowed to rotate relative to the fixed frame 20. Meanwhile, when the above sliding door 2 is operated in a closed state and the first displacement member 40 is slid to the first position, the guiding column 31 is guided by the guiding groove 42 to rotate the first latching member 30 and at least portion of the first latching member 30 runs through the at least one through opening 43 and protrudes from the edge surface 10*a* to make an end of the first latching member 30 and the first latching slot 93 be engaged with each other. Consequently, it is achieved to latch the sliding door 2 in the closed state. On the other hand, when the first displacement member 40 is slid to the second position, the guiding column 31 is guided by the guiding groove 42 to rotate the first latching member 30 and the first latching member 30 is received within the at least one through opening 43. Namely, the first latching member 30 doesn't run through the edge surface 10*a*, and the end of the first latching member 30 is separated from the first latching slot 93. Consequently, it is achieved to unlatch the sliding door 2 in the closed state. In addition, the second displacement member 50 is received within the accommodation slot 11 and adjacent to the first displacement member 40. Similarly, the second displacement member 50 is disposed on the first side 20*a* of the fixed frame 20 and slid between a third position and a fourth position along the first axial direction, for example the vertical Z-axis direction. Since the first displacement member 40 and the second displacement member 50 are adjacent to each other and both are displaced along the first axial direction, for example the vertical Z-axis direction, when the first displacement member 40 is slid to the first position, the second displacement member 50 is driven to slide to the third position by the third displacement member 40 simultaneously. On the other hand, when the first displacement member 40 is slid to the second position, there is a sufficient space provided for allowing the second displacement member 50 to slide between the third position and the fourth position. Moreover, in the embodiment, the second latching member 50 includes a limitation portion 54 aligned with the limitation window 25. The second latching member 60 is pivotally connected to an additional frame 61 and the additional frame 61 is fixed on the second side 20*b* of the fixed frame 20, so that the second latching member 60 is allowed to rotate and displace relative to the fixed frame 20. The second latching member 60 includes a limitation end 63 running through the limitation window 25 and engaged with the limitation portion 54. In the embodiment, the limitation portion 54 can be for example an inclined plane. In addition, a spring 62 is disposed between the second latching member 60 and the additional frame 61, so as to provide an elastic force, which is utilized to drive the second latching member 60 to rotate relative to the fixed frame 20 and make at least a portion of the second latching member 60, for example a tongue structure 60*a*, protrude from the first lateral surface 10*b*. However, the spring 62 is not an essential feature to limit the present disclosure, and not redundantly described herein. In case of the sliding door 2 being operated in the open state, the second latching member 60 being aligned with the second latching slot 94 and the second displacement member 50 being slid to the fourth position, the limitation end 63 is driven by the limitation portion 54 to rotate the second latching member 60 relative to the fixed frame 20 and make the tongue structure 60*a* of the second latching member 60 protrude from the first lateral surface 10*b*. Thereby, the tongue structure 60*a* of the second latching member 60 and the second latching slot 94 are engaged with each other and it is achieved to latch the sliding door 2 in the open state. Furthermore, when the second displacement member 50 is slid to the third position, the limitation end 63 is driven by the limitation portion 54 to rotate the second latching member 60 relative to the fixed frame 20 to receive within the accommodation slot 11. Thereby, the second latching member 60 is separated from the second latching slot 94 and it is achieved to unlatch the sliding door 2 in the open state. In respect to operations of the latching device 1 and the sliding door 2, it will be described as follows.

On the other hand, it is noted that, in the embodiment, the first displacement member 40 and the second displacement member 50 are adjacent to each other. Furthermore, the first displacement member 40 includes a first engagement component 44 and the second displacement member 50 includes a second engagement component 53. The first engagement component 44 and the second engagement component 53 are corresponding to each other. When the first displacement member 40 is slid to the first position, the first engagement component 44 and the second engagement component 53 are engaged with each other to drive the second displacement member 50 to slide to the third position. In the embodiment, the second displacement member 50 further includes an elastic component 52 having an end set on the fixing post 26 on the fixed frame 20. The elastic component 52 is disposed between the second displacement member 50 and the fixed frame 20 and configured to push the second displacement member 50 toward the first displacement member 40. When the first displacement member 40 is slid to the second position, the second displacement member 50 is pushed by the elastic component 52 and slid to the fourth position, so that the first engagement component 44 and the second engagement component 53 are maintained to engage with each other. Moreover, when the first displacement member 40 is slid to the first position, the first engagement component 44 and the second engagement component 53 are engaged with each other, and the second displacement member 50 is pushed by the first displacement member 40 to resist the elastic force of the elastic component 52. Thereby, the second displacement member 50 is slid to the third position. Moreover, in order to facilitate the user to operate, the first displacement member 40 includes at least one first recess 41, which is uncover on the first lateral surface 10*b* or the second lateral surface 10*c* of the main body 10, and configured to be driven by a force from the user to slide the first displacement member 40 between the first position and the second position. Similarly, the second displacement member 50 includes a second recess 51, which is uncover on the edge surface 10*a* of the main body 10, and configured to be driven by a force from the user to slide the second displacement member 50 between the third position and the fourth position.

In the embodiment, the latching device 1 further includes a cover body 12 configured to allow the first displacement member 40 and the second displacement member 50 sliding on the first side 20*a* of the fixed frame 20. Preferably but not exclusively, the cover body 12 is fixed on the main body 10 by screws and is assembled to cover the accommodation slot 11 so as to limit the displacement space of the first displacement member 40 and the second displacement member 50. In the embodiment, the cover body 12 includes an edge surface 17, a first lateral surface 18 and a second lateral surface 19, which are connected with the edge surface 10*a*, the first lateral surface 10*b* and the second lateral surface 10*c* of the main body 10, respectively. Moreover, the body cover 12 further includes at least one first opening 13, at least one second opening 14*a*, 14*b*, a third opening 15 and a fourth opening 16. The first opening 13 is disposed on the edge surface 17 and aligned to the at least one through opening 43. Thereby, when at least portion of the first latching member 30 runs through the at least one through opening 43, the first opening 13 allows the first latching member 30 to protrude from the edge surface 17. Namely, the first latching member 30 protrudes from the edge surface 10*a*. In the embodiment, the cover body 12 includes for example two second opening 14*a*, 14*b*, disposed on the first lateral surface 18 and the second lateral surface 19, respectively. The two opening 14*a* are aligned to the two opposite first recesses 41 of the first displacement member 40, respectively. It facilitates the user to operate the first displacement member 40 through the second openings 14*a*, 14*b*, and benefits to achieve the purpose of operating the first displacement member 40 through the first lateral surface 18 or the second lateral surface 19. In the embodiment, the third opening 15 is disposed on the first lateral surface 18 and aligned with the second latching member 60. Thereby, it allows the second latching member 60 to run through the third opening 15 and to protrude from the first lateral surface 18. Moreover, in the embodiment, the fourth opening 16 is disposed on the edge surface 17 and aligned to the second recess 51 of the second displacement member 50, so as to facilitate the user to operate the second displacement member 50 through the fourth opening 16 and benefit to achieve the purpose of operating the second displacement member 50 through the edge surface 17. On the other hand, the fixed frame 20 includes at least one first positioning rail 22 disposed on the first side 20*a*. The first displacement member 40 includes at least one first positioning component 45 forming by for example a combination of a ball and a spring. One end of the spring is embedded in the first displacement member 40 and the other end of the spring abuts against the ball. Thus, the ball of the first positioning component 45 is engaged with the at least one first positioning rail 22 to achieve the purpose of guiding the first displacement member 40 to slide between the first position and the second position along the first axial direction, for example the vertical Z-axis direction. Similarly, the fixed frame 20 further includes at least one second positioning rail 24 disposed on the first side 20*a*. The second displacement member 50 includes at least one second positioning component 55 forming by for example a combination of a ball and a spring. One end of the spring is embedded in the second displacement member 50 and the other end of the spring abuts against the ball. Thus, the ball of the second positioning component 55 is engaged with the at least one second positioning rail 24 to achieve the purpose of guiding the second displacement member 50 to slide between the third position and the fourth position along the first axial direction, for example the vertical Z-axis direction. Certainly, the arrangements for guiding the first displacement member 40 to displace along the first axial direction or guiding the second displacement member 50 to displace along the first axial direction are not limited thereto. In the embodiment, the fixed frame 20 further a slot opening 23 disposed along the first axial direction, for example the vertical Z-axis direction. The first displacement member 40 includes a positioning column 46, wherein at least portion of the positioning column 46 is received within the slot opening 23 and configured to limit the first displacement member 40 sliding between the first position and the second position along the first axial direction. It should be emphasized that the method of sliding the first displacement member 40 and the second displacement member 50 along the first axial direction is not limited to the above embodiments. Any method capable of displacing the first displacement member 40 between the first position and the second position or displacing the second displacement member 50 between the third position and the fourth position can be implemented. The present disclosure is not limited thereto and not redundantly described herein.

Figure 5:
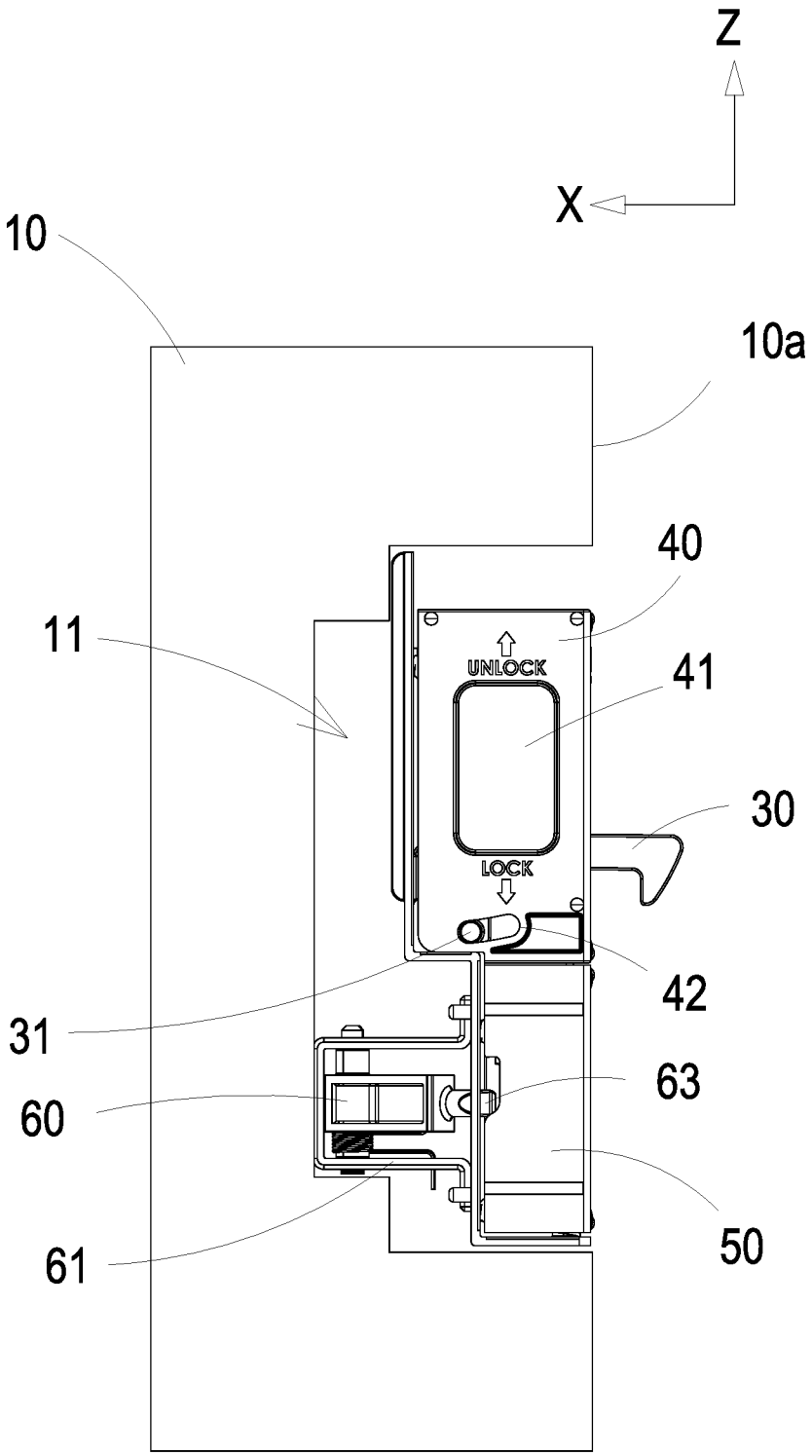
FIG. 5 is an exemplary structure illustrating the action relationship among the components of the latching device of the present disclosure, which are operated in a first state.
Figure 6:
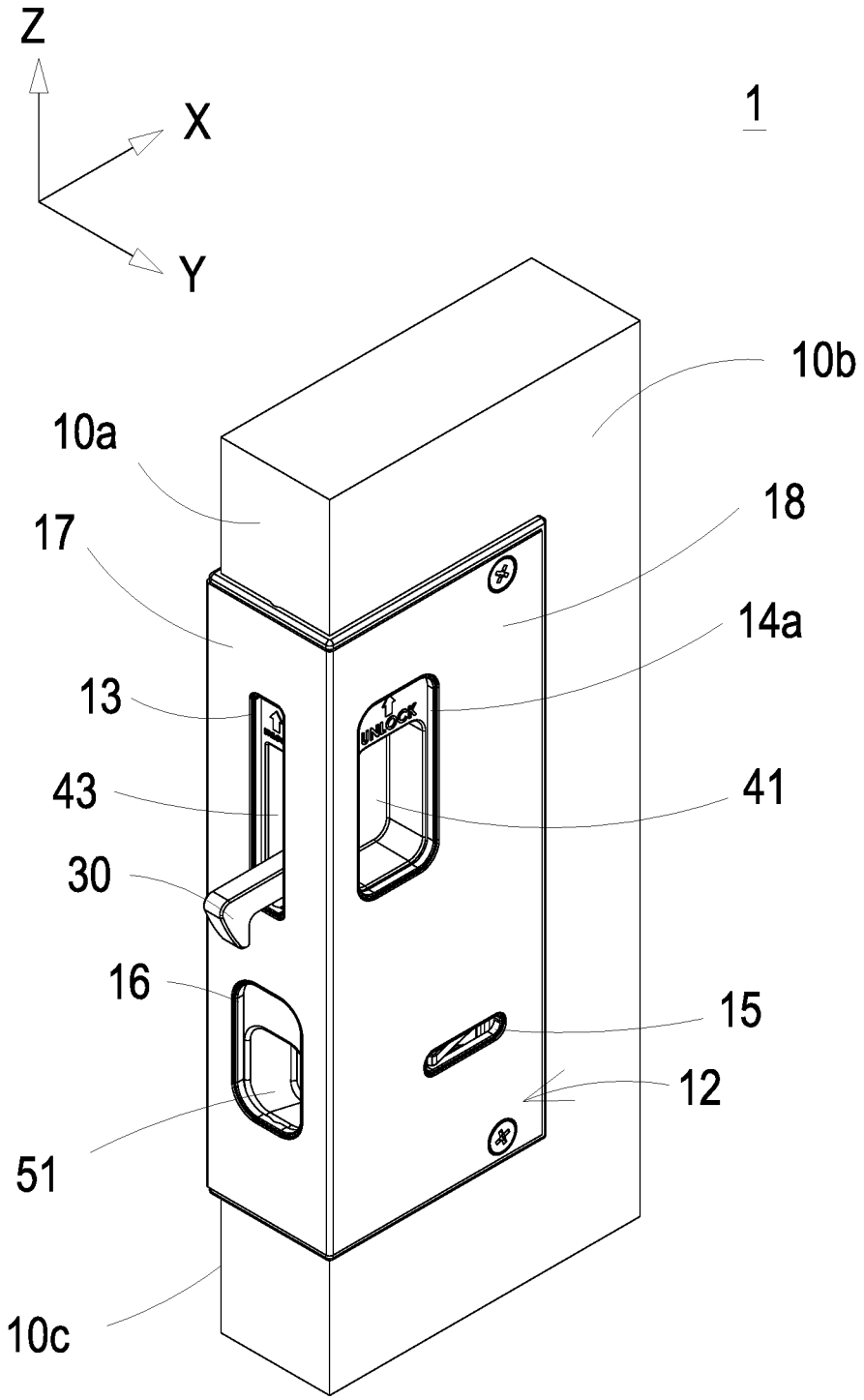
FIG. 6 is a perspective structural view illustrating the latching device of the present disclosure operated in the first state.
Figure 7:
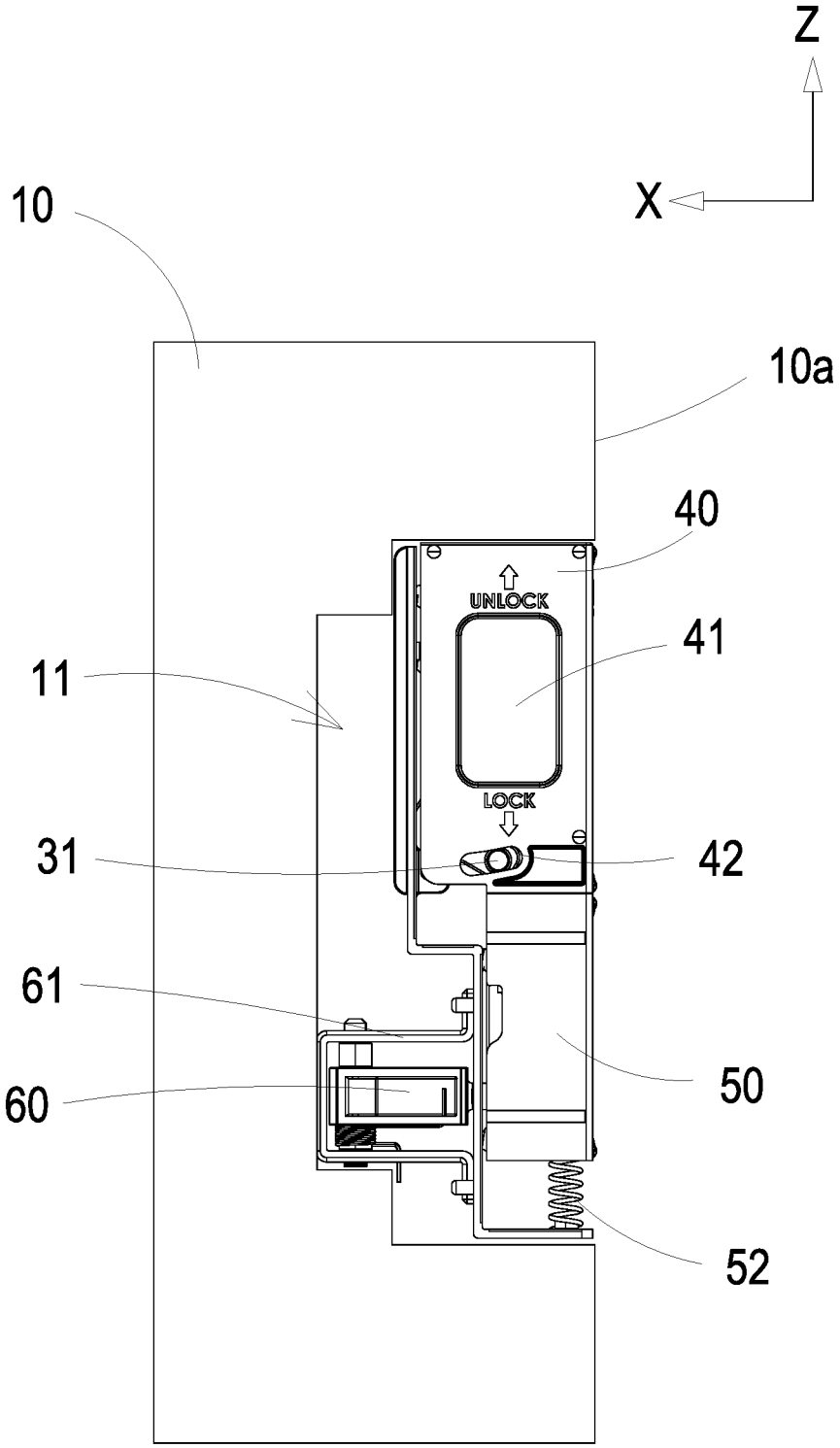
FIG. 7 is an exemplary structure illustrating the action relationship among the components of the latching device of the present disclosure, which are operated in a second state.
Figure 8:
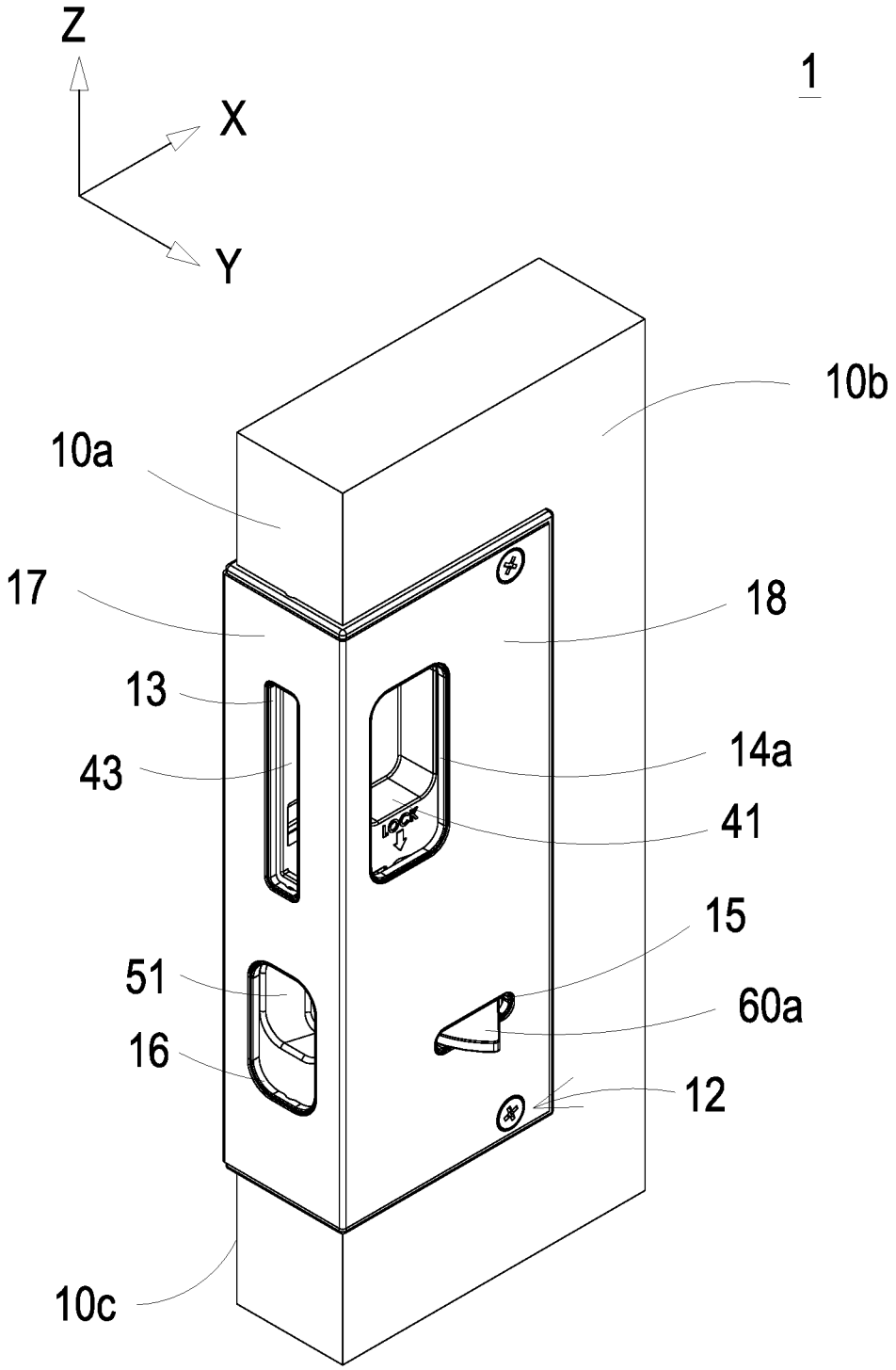
FIG. 8 is a perspective structural view illustrating the latching device of the present disclosure operated in the second state.
Figure 9:
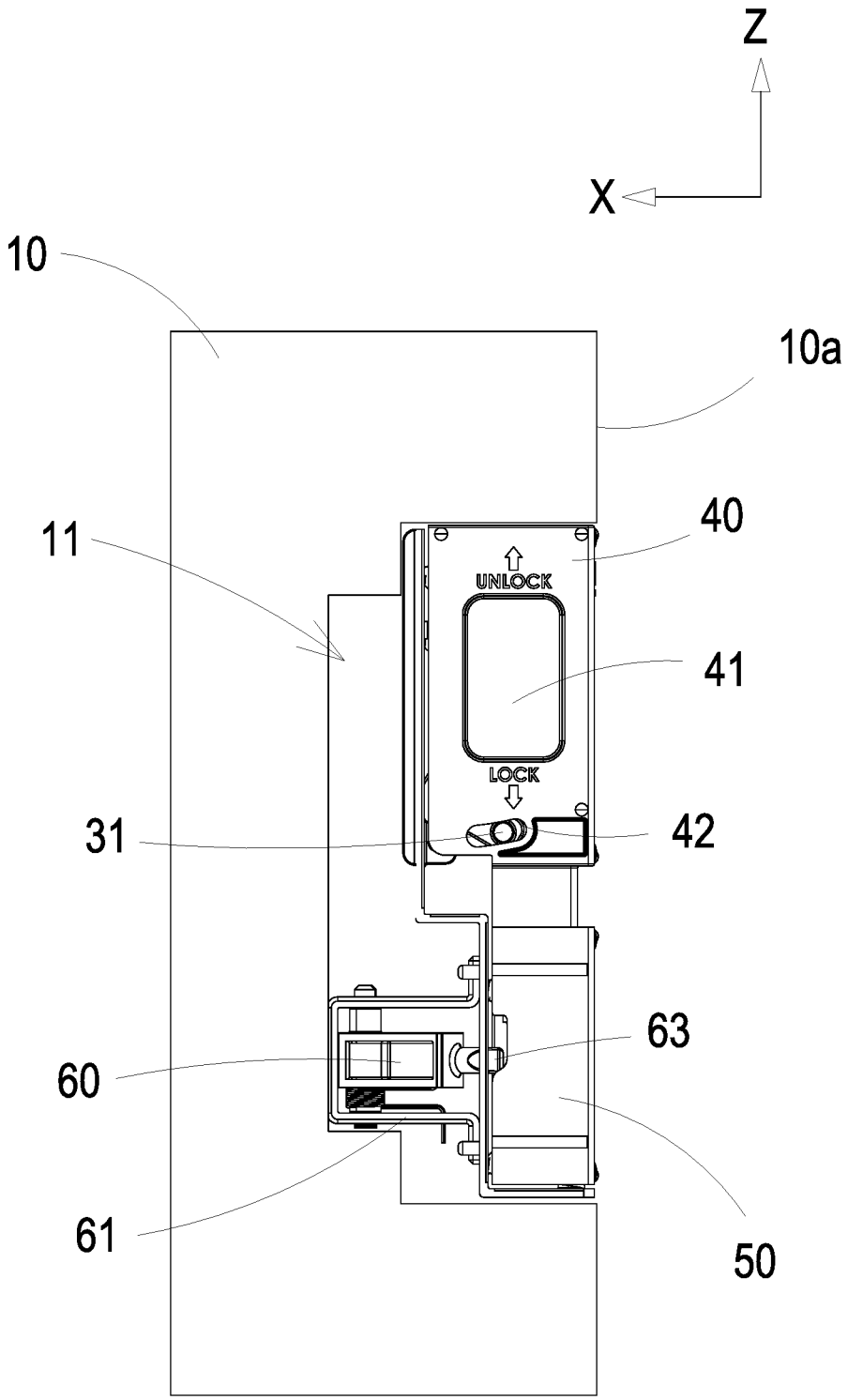
FIG. 9 is an exemplary structure illustrating the action relationship among the components of the latching device of the present disclosure, which are operated in a third state.
Figure 10:
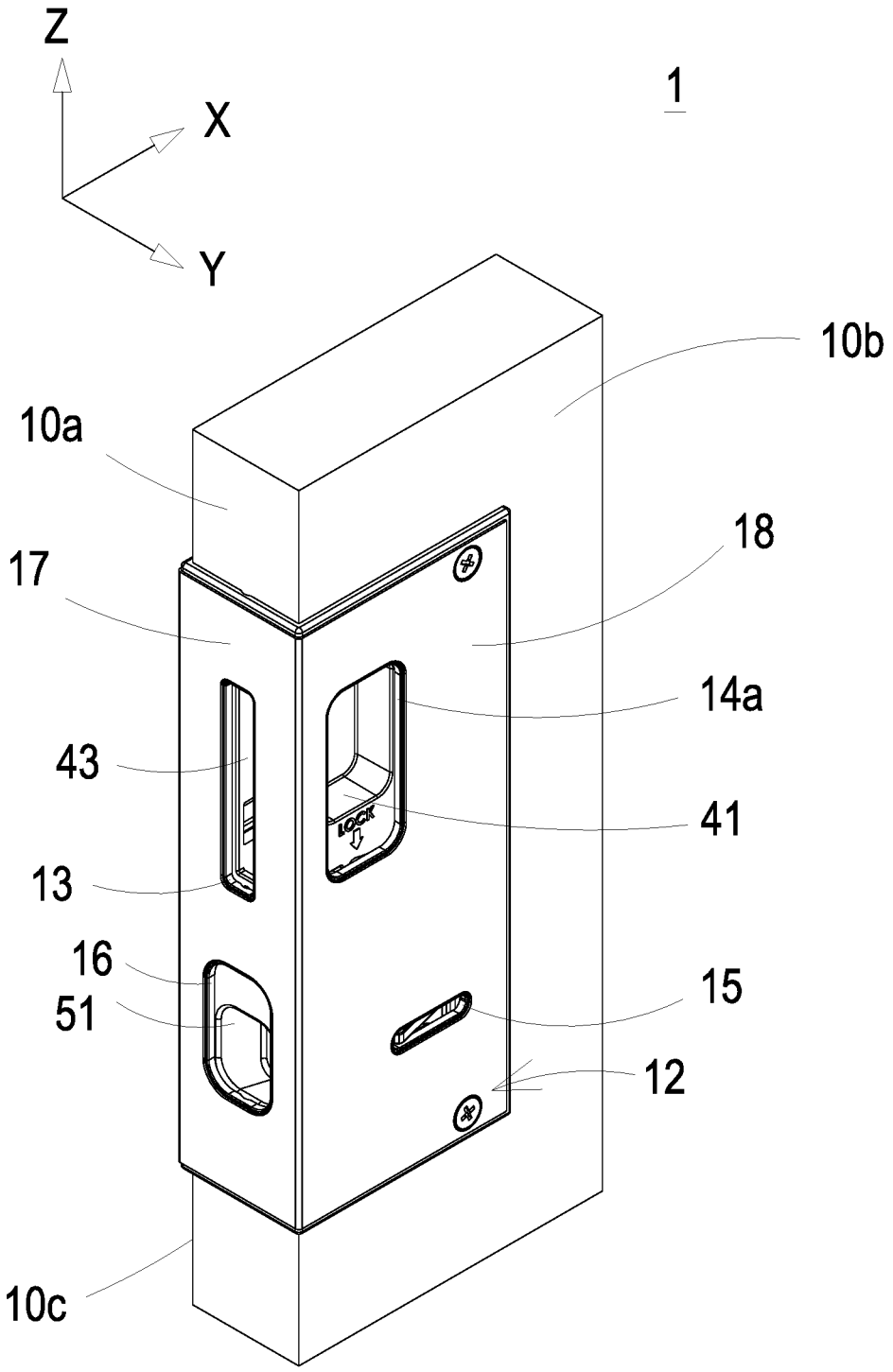
FIG. 10 is a perspective structural view illustrating the latching device of the present disclosure operated in the third state.

In respect to the operations of the latching device 1 and the sliding door 2, please refer to FIG. 1 and FIGS. 5 to 10. FIG. 5 is an exemplary structure illustrating the action relationship among the components of the latching device of the present disclosure, which are operated in a first state. FIG. 6 is a perspective structural view illustrating the latching device of the present disclosure operated in the first state. FIG. 7 is an exemplary structure illustrating the action relationship among the components of the latching device of the present disclosure, which are operated in a second state. FIG. 8 is a perspective structural view illustrating the latching device of the present disclosure operated in the second state. FIG. 9 is an exemplary structure illustrating the action relationship among the components of the latching device of the present disclosure, which are operated in a third state. FIG. 10 is a perspective structural view illustrating the latching device of the present disclosure operated in the third state. Firstly, as shown in FIG. 1, the sliding door 2 is allowed to operate. When the user pulls the sliding main body 10', namely the main body 10 of the latching device 1, to slide away from the doorjamb 91, the sliding door 2 is operated in the open state, wherein the first lateral surface 10*b* is attached to the sidewall 92 and the second latching member 60 is aligned with the second latching slot 94. On the contrary, when the user pulls the sliding main body 10', namely the main body 10 of the latching device 1, to slide for example along the reversed X-axis direction and make the main body 10 be attached to the doorjamb 91, the latching device 1 is operated in the closed state, wherein the edge surface 10*a* is attached to the surface of the doorjamb 91 and the first latching member 30 is aligned with the first latching slot 93. In case of the sliding door 2 being operated in the closed state, namely the edge surface 10*a* attached to the surface of the doorjamb 91 and the first latching member 30 aligned with the first latching slot 93, the user is allowed to move the first displacement member 40 to the first position through the first recess 41 disposed on the first lateral surface 10*b* or the second lateral surface 10*c*, to make the first latching member 30 protrude from the edge surface 10*a*, as shown in FIGS. 5 and 6. In that, an end of the first latching member 30, for example a hook end, is engaged with the first latching slot 93 (refer to FIG. 1) to achieve the purpose of latching the sliding door 2 in the closed state. Meanwhile, the second displacement member 50 is abutted against by the first displacement member 40 and moves toward the third position. Thereby, the second latching member 60 is driven to be received within the accommodation slot 11 instead of protruding from the first lateral surface 10*b*. No matter the user faces to the first lateral surface 10*b* or the second lateral surface 10*c*, the latched sliding door 2 in the closed state is allowed to unlatch by the user. It is achieved by sliding the first displacement member 40 from the first position (as shown in FIG. 5) to the second position (as shown in FIG. 7) through the uncovered first recess 41. The first latching member 30 is driven by the first displacement member 40 to separate from the first latching slot 93 and be received within the through opening 43 instead of protruding from the edge surface 10*a*. Consequently, the sliding door 2 in the closed state is unlatched. Furthermore, since the first displacement member 40 is moved to the second position, the sufficient space is provided for allowing the second displacement member 50 to slide from the third position to the fourth position by the elastic component 52 pushing the second displacement member 50. Thereby, the first displacement member 40 is engaged with the second displacement member 50. At the same time, the tongue structure 60*a* of the second latching member 60 is driven by the second displacement member 50 to protrude along for example the Y-axis direction from the first lateral surface 10*b*, as shown in FIG. 8. Meanwhile, the sliding door 2 is allowed to slide freely. In the embodiment, the second latching member 60 is pushed by the elastic force of the spring 62 to abut against the limitation portion 54, for example the inclined plane, so that the tongue structure 60*a* protrudes from the first lateral surface 10*b*. When the user slides the first lateral surface 10*b* of the main body 10 to attach the sidewall 92, the tongue structure 60*a* is in continuous contact with the sidewall 92 and pushed to drive the limitation end 63 of the second latching member 60 away from the limitation portion 54, for example the inclined plane. Consequently, the tongue structure 60*a* is temporarily received within the accommodation slot 11. When the main body 10 is slid and operated in the open state, the second latching member 60 is aligned to the second latching slot 94. In that, the tongue structure 60*a* of the second latching member 60 fails to abut against the sidewall 92, but is engaged with the second latching slot 94. Consequently, the sliding door 2 in the open state is latched. Furthermore, in case that the sliding door 2 is a concealed sliding door, the edge surface 10*a* is uncovered while the sliding door 2 is operated in the open state. When the user tends to unlatch the latched sliding door 2 in the open state, the second displacement member 50 can be slid from the fourth position (as shown in FIG. 7) to the third position (as shown in FIG. 9) along the reversed Z-axis direction by pulling the second recess 51 uncovered from the edge surface 10*a*. In that, the first displacement member 40 is maintained at the second position and the first latching member 30 is received within the accommodation slot 11 instead of protruding from the edge surface 10*a*. Furthermore, since the second latching member 60 is drive by the second displacement member 50, the second latching member 60 is separated from the second latching slot 94 and received within the accommodation slot 11 instead of protruding from the first lateral surface 10*b*, as shown in FIG. 10. Consequently, the sliding door 2 in the open state is unlatched. Moreover, the main body 10 is allowed to slide along for example X-axis direction by pulling the second recess 51. When the tongue structure 60*a* of the second latching member 60 is out of the range of the second latching slot 94 on the sidewall 92, the user can release the second recess 51. In that, the second displacement member 50 is pushed by the elastic component 52 to slide the second displacement member 50 to the fourth position and the tongue structure 60*a* of the second latching member 60 is driven to protrude from the first lateral surface 10*b*, as shown in FIG. 8. By the above operations of the latching device 1, it is achieved to latch and unlatch the sliding door 2 in the open state and the closed state. The safety and practicality of the sliding door 2 can be improved.

Figure 11:
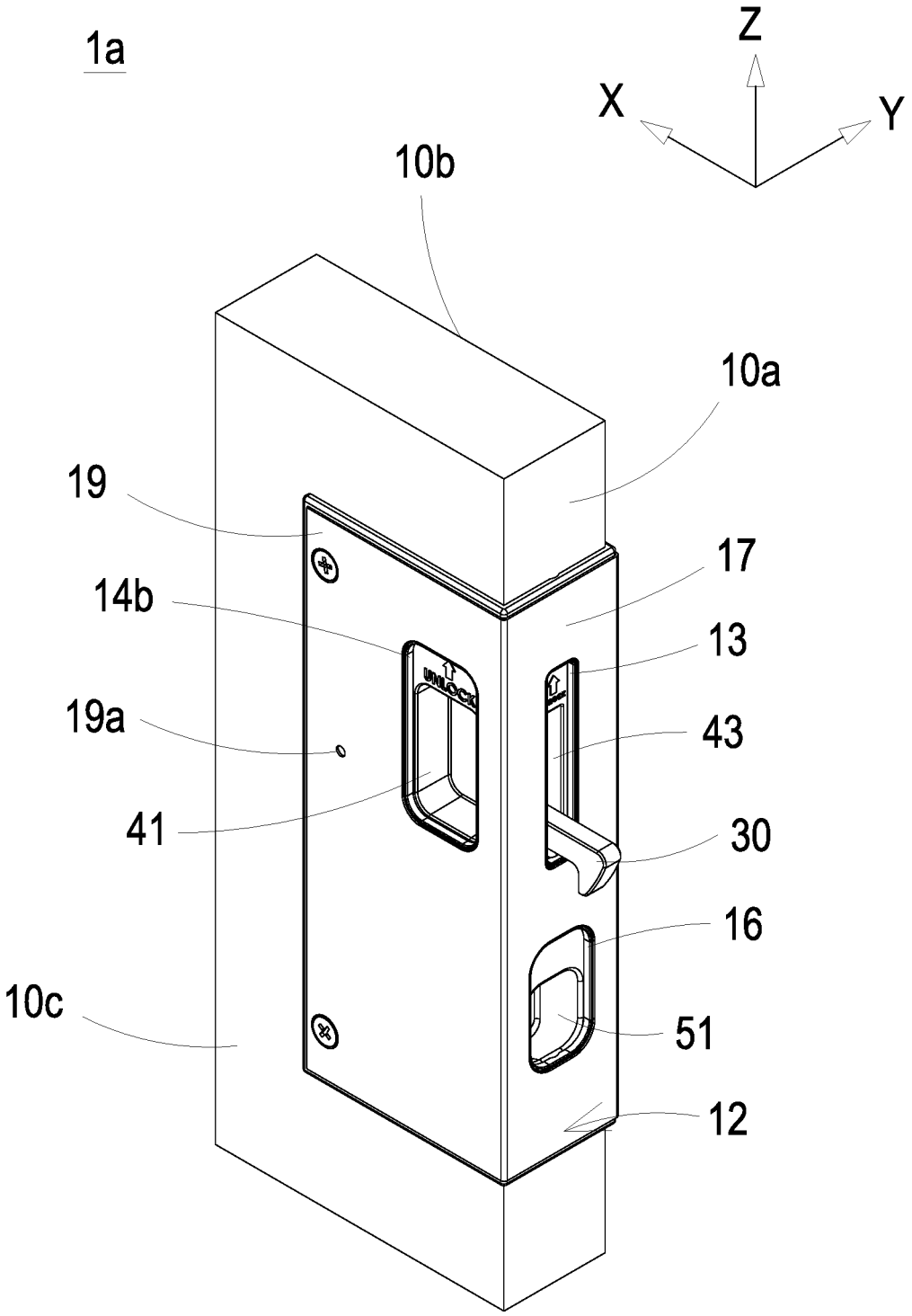
FIG. 11 is a perspective structural view illustrating a latching device according to a second embodiment of the present disclosure.
Figure 12:
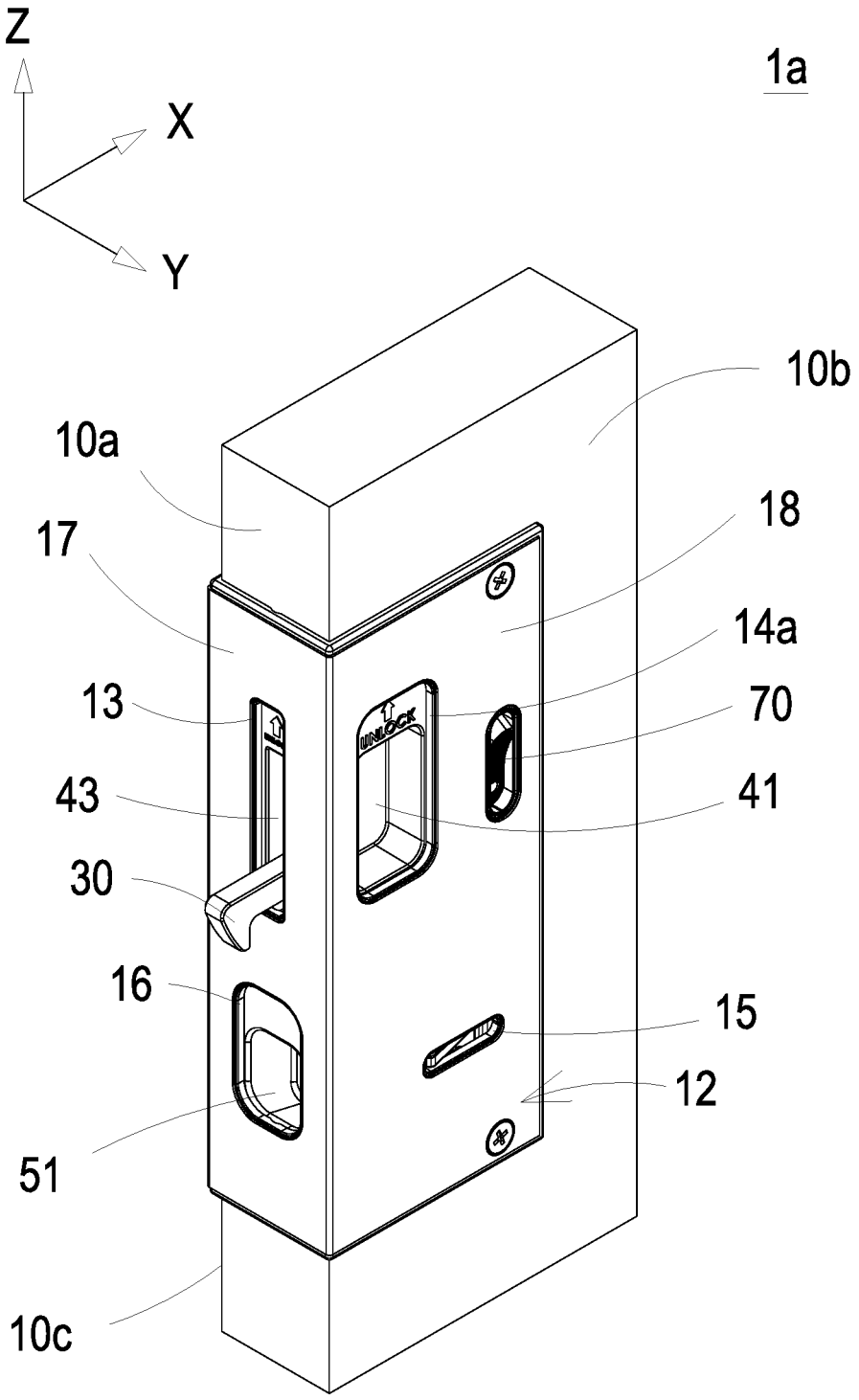
FIG. 12 is a perspective structural view illustrating the latching device according to the second embodiment of the present disclosure and taken from a different perspective.
Figure 13:
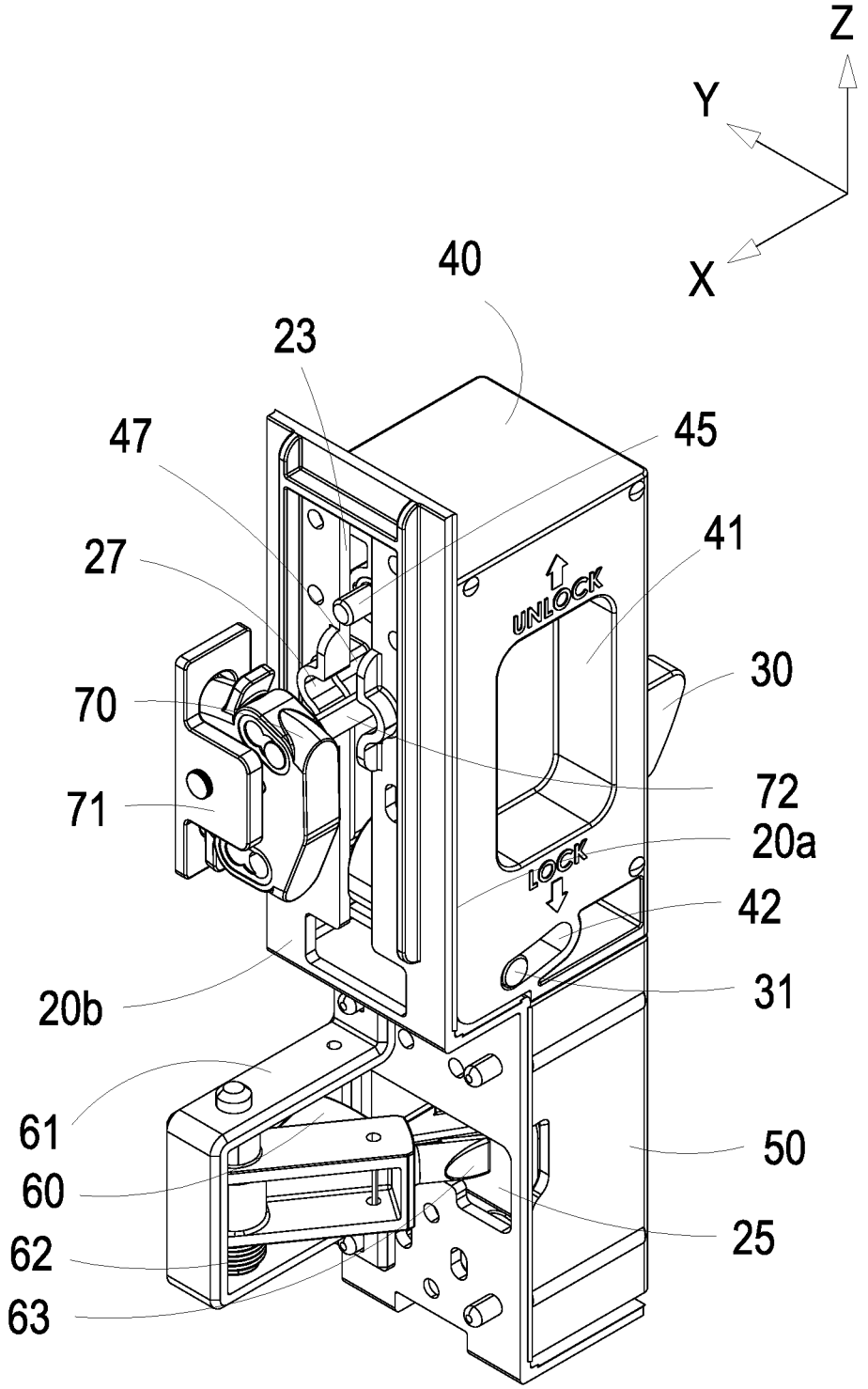
FIG. 13 is a perspective structural view illustrating a partial structure of the latching device according to the second embodiment of the present disclosure.

FIG. 11 is a perspective structural view illustrating a latching device according to a second embodiment of the present disclosure. FIG. 12 is a perspective structural view illustrating the latching device according to the second embodiment of the present disclosure and taken from a different perspective. FIG. 13 is a perspective structural view illustrating a partial structure of the latching device according to the second embodiment of the present disclosure. In the embodiment, the structures, elements and functions of the latching device 1*a* are similar to those of the latching device 1 of FIGS. 2 to 10, and are not redundantly described herein. In the embodiment, the first displacement member 40 of the latching device 1*a* further includes a limitation slot 47 in communication with the at least one through opening 43. The latching device 1*a* further comprises a third latching member 70 pivotally connected to the cover body 12 through the base 71, which is embedded in the cover body 12. Thereby, the third latching member 70 is allowed to rotate relative to the cover body 12. Moreover, the third latching member 70 further includes a switch button for the user to operate. The switch button is uncovered by the first lateral surface 18 of the cover body 12. In the embodiment, the third latching member 70 includes a limitation column 72, which runs through the slot opening 23 of the fixed frame 20 and has at least portion received within the at least one through opening 43. The third latching member 70 shown in FIG. 13 is operated in a released state. Since the limitation column 72 of the third latching member 70 runs through the slot opening 23 of the fixed frame 20 and has at least portion received within the at least one through opening 43, the displacement of the first displacement member 40 between the first position and the second position is not influenced by the arrangement of the limitation column 72. Namely, the latching device 1*a* can be implemented to achieve the purposes of latching and unlatching the sliding door 2 (refer to FIG. 1) in the opened state and the closed state by the above operations. Furthermore, in the embodiment, when the latching device 1*a* is operated to latch the sliding door 2 in the closed state, the third latching member 70 further provides an auxiliary latch mechanism to ensure the latched state of the sliding door 2.

Figure 14:
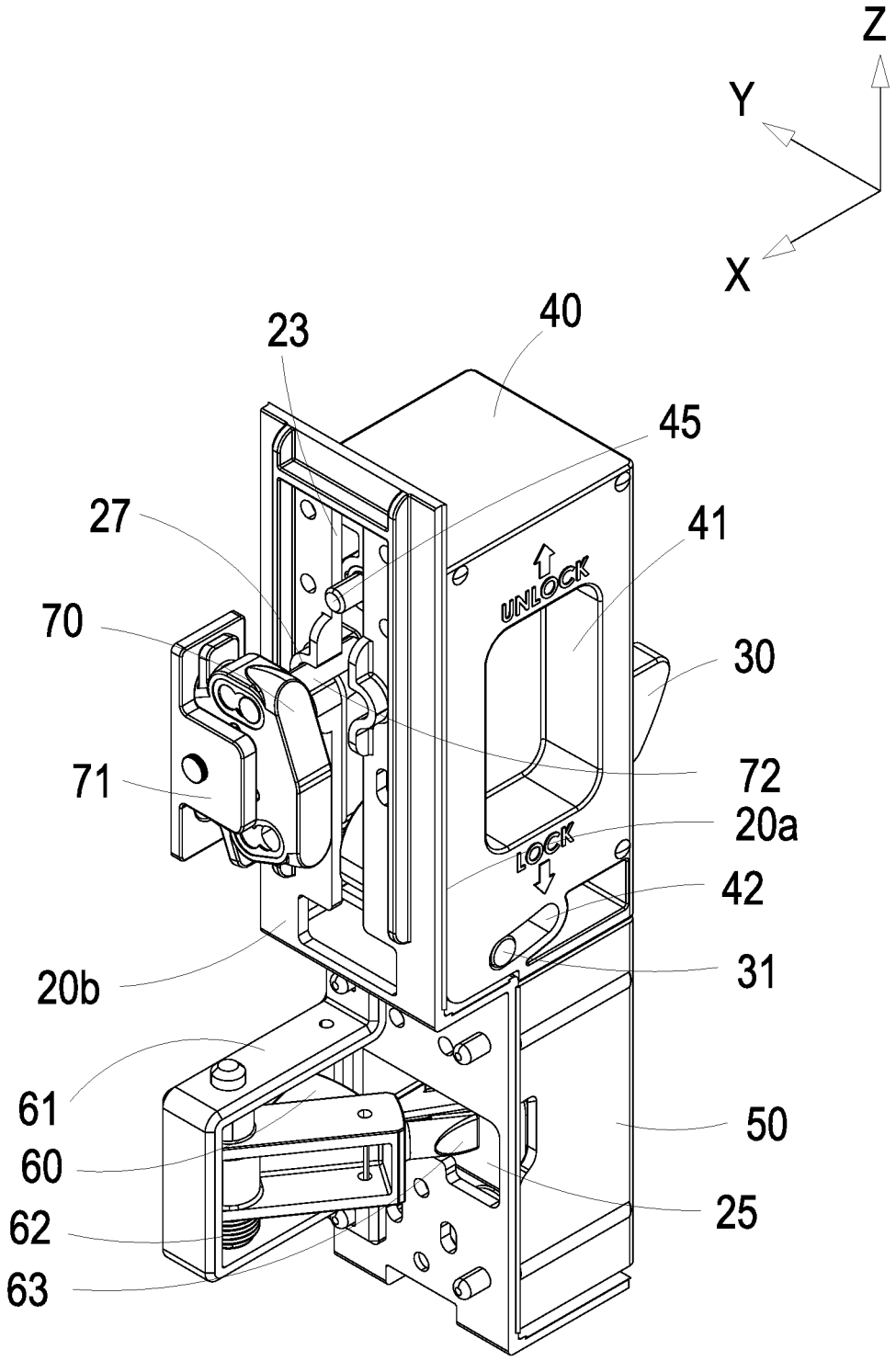
FIG. 14 is a perspective structural view illustrating the third latching component of the latching device operated to latch.
Figure 15:
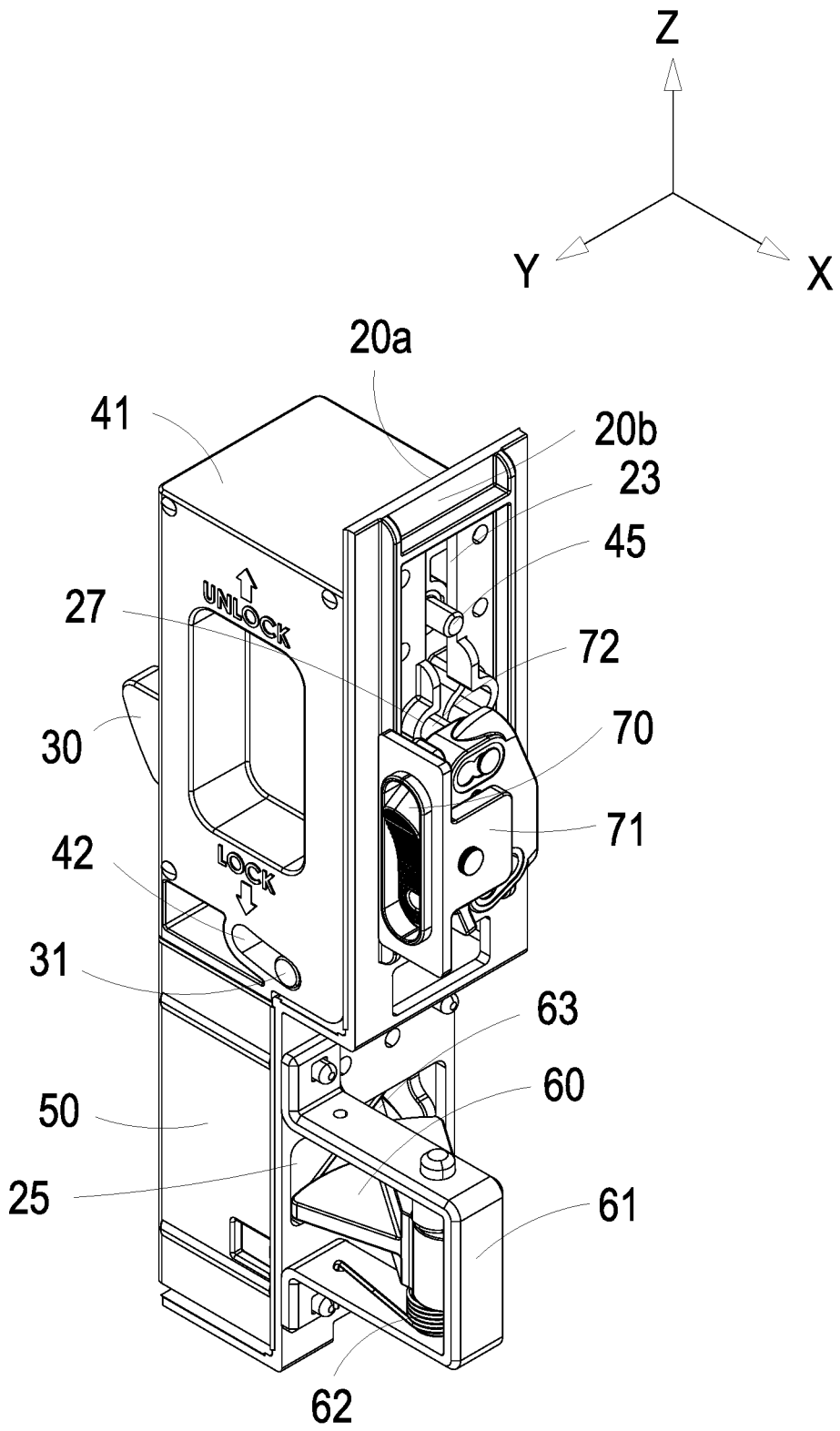
FIG. 15 is another perspective structural view illustrating the third latching component of the latching device operated to latch and taken from a different perspective.

FIG. 14 is a perspective structural view illustrating the third latching component of the latching device operated to latch. FIG. 15 is another perspective structural view illustrating the third latching component of the latching device operated to latch and taken from a different perspective. When the latching device 1*a* is operated to latch the sliding door 2 in the closed state, the first displacement member 40 is moved to the first position and the limitation column 72 is aligned to the limitation slot 47. In that, the user is allowed to press the switch button of the third latching member 70 uncovered from the first lateral surface 18 of the cover body 12, so as to rotate the third latching member 70 and drive the limitation column 72 to be displaced. Consequently, the limitation column 72 is moved to the limitation slot 47 of the first displacement member 40 and engaged with the limitation slot 47. Thus, the first displacement member 40 is blocked by the limitation column 72 of the third latching member 70 and free of the displacement between the first position and the second position. It ensures that the latched sliding door 2 in the closed state is maintained. When the user wants to unlatch the third latching member 70, the switch button of the third latching member 70 uncovered from the first lateral surface 18 of the cover body 12 can be reversely pressed, so as to separate the limitation column 72 from the limitation slot 47 and be received within the at least one through opening 43, as shown in FIG. 13. In that, the latching device 1*a* can be used to perform the same operations of the latching device 1 as described above, and achieve the purposes of latching and unlatching the sliding door 2 in the closed state or the open state. It is not redundantly described hereafter. In the embodiment, the cover body 12 further includes a reset hole 19*a*, which is disposed on the second lateral surface 19 of the cover body 12, opposite to the third latch assembly 70 embedded in the first lateral surface 18, and configured to reset the position of the third latching member 70. Preferably but not exclusively, the user can use a needle to abut against the third latching member 70 through the reset hole 19*a*, so as to make the limitation column 72 be separated from the limitation slot 47 and received within the at least one through opening 43. Consequently, the third latching member 70 in the latched state is released. It should be noted that the latching manner of the third latching member 70 is exemplary merely. Any other ways capable of latching the first displacement member 40 can be applied to the third latching member 70 of the present disclosure. In addition, the auxiliary latch mechanism of the third latching member 70 can be utilized to ensure the latching of the sliding door 2 in the closed state, but not limited thereto. Certainly, the present disclosure is not limited thereto, and not redundantly described herein.

In summary, a latching device and a sliding door using the same are provided. The latching device includes at least two latching members, which can be latched in latching slots disposed in a doorjamb and a sidewall of the sliding door along different directions, respectively. Thus, no matter when the sliding main body is in a closed position or in an opened position, the latching device can be utilized to latch the sliding door, so as to improve the safety of the sliding door. The at least two latching members of the latching device are correspondingly operated through at least two displacement members connected to each other. Thus, the user can simply operate with one hand to achieve the function of fixing the sliding main body in the closed position or the open position. Moreover, the at least two latching members of the latching device are disposed on the sliding main body of the sliding door and can be operated from two opposite sides of the sliding door. Moreover, the latching device is correspondingly operated through at least two displacement members connected to each other. In addition to fixing the sliding door in the open position of the sliding door, the latching device can be operated through the displacement component disposed on the edge surface of the sliding main body to unlatch the sliding door. Therefore, the latching device of the present disclosure can be further implemented in a concealed sliding door. When the concealed sliding door is fully opened and the two opposite sides of the sliding main body are both hidden in the walls, the sliding door can be latched automatically. Moreover, the latched sliding main body can be unlatched by operating the latching device through the edge surface of the sliding door. It benefits of effectively improving the safety and practicality of the sliding door. It also avoids the unexpected switching action caused by shaking.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A latching device, comprising:

a main body comprising an edge surface, at least one lateral surface and an accommodation slot, wherein the accommodation slot is disposed and adjacent to the edge surface and the at least one lateral surface, the edge surface is aligned to a first latching slot, and the at least one lateral surface is aligned to a second latching slot;

a fixed frame disposed on the main body and received within the accommodation slot, wherein the fixed frame comprises a first side, a second side and a limitation window, the first side and the second side are opposite to each other, and the first side faces to the edge surface;

a first displacement member received within the accommodation slot, disposed on the first side of the fixed frame and slid between a first position and a second position along a first axial direction, wherein the first displacement member comprises at least one through opening and at least one guiding groove;

a first latching member pivotally connected to the fixed frame and comprising a guiding column, wherein at least portion of the guiding column is received within the guiding groove, wherein when the first displacement member is slid to the first position, the guiding column is guided by the guiding groove to rotate the first latching member and at least portion of the first latching member runs through the at least one through opening and protrudes from the edge surface to make the first latching member and the first latching slot be engaged with each other, wherein when the first displacement member is slid to the second position, the guiding column is guided by the guiding groove to rotate the first latching member and the first latching member is received within the at least one through opening;

a second displacement member received within the accommodation slot and adjacent to the first displacement member, wherein the second displacement member is disposed on the first side of the fixed frame and slid between a third position and a fourth position along the first axial direction, and the second displace member comprises a limitation portion aligned with the limitation window; and a second latching member pivotally connected to the fixed frame and comprising a limitation end running through the limitation window and engaged with the limitation portion, wherein when the second displacement member is slid to the third position, the limitation portion drives the limitation end to rotate the second latching member to be received within the accommodation slot, wherein when the second displacement member is slid to the fourth position, the limitation portion drives the limitation end to rotate the second latching member to protrude at least portion of the second latching member from the at least one lateral surface to make the second latching member and the second latching slot be engaged with each other.

2. The latching device according to claim 1, wherein the first displacement member comprises a first engagement component and the second displacement member comprises a second engagement component, wherein the first engagement component and the second engagement component are aligned with each other, wherein when the first displacement member is slid to the first position, the first engagement component and the second engagement component are engaged with each other to drive the second displacement member to slid to the third position.

3. The latching device according to claim 1, wherein the second displacement member comprises an elastic component disposed between the second displacement member and the fixed frame and configured to push against the second displacement member toward the first displacement member, wherein when the first displacement member is slid to the second position, the second displacement member is pushed by the elastic component to slide to the third position, and the first engagement component and the second engagement component are engaged with each other.

4. The latching device according to claim 1, wherein the first displacement member comprises at least one first recess uncovered on the at least one lateral surface of the main body and configured to be driven by a force from a user to slide the first displacement member between the first position and the second position.

5. The latching device according to claim 4, wherein the second displacement member comprises at least one second recess uncovered on the edge surface of the main body and configured to be driven by a force from a user to slide the second displacement member between the third position and the fourth position.

6. The latching device according to claim 5, further comprising a cover body covering the accommodation slot, wherein the cover body comprises at least one first opening, at least one second opening, a third opening and a fourth opening aligned to the at least one through opening, the at least one first recess, the second latching member and the at least one second recess, respectively.

7. The latching device according to claim 1, wherein the fixed frame comprises at least one first positioning rail disposed on the first side, and the first displacement member comprises at least one first positioning component engaged with the at least one first positioning rail to guide the first displacement member to slide between the first position and the second position along the first axial direction, wherein the fixed frame comprises at least one second positioning rail disposed on the first side, and the second displacement member comprises at least one second positioning component engaged with the at least one second positioning rail to guide the second displacement member to slide between the third position and the fourth position along the first axial direction.

8. The latching device according to claim 1, wherein the fixed frame comprises a slot opening disposed along the first axial direction, and the first displacement member comprises a positioning column having at least portion received within the slot opening and configured to limit the first displacement member sliding between the first position and the second position along the first axial direction.

9. The latching device according to claim 8, wherein the first displacement member comprises a limitation slot in communication with the at least one through opening, and the latching device further comprises a third latching member pivotally connected to the cover body, wherein the third latching member comprises a limitation column running through the slot opening and having at least portion received within the at least one through opening, wherein when the first displacement member is slid to the first position and the limitation column is aligned to the limitation slot, the third latching member is rotated to drive the limitation column to engage with the limitation slot, and the first displacement member is blocked at the first position.

10. A sliding door, comprising:

a door frame comprising at least one doorjamb and at least one sidewall, wherein the at least one doorjamb comprises a first latching slot and the at least one sidewall comprises a second latching slot;

a sliding main body slidably disposed on the door frame and comprising an edge surface, at least one lateral surface and an accommodation slot, wherein the accommodation slot is disposed and adjacent to the edge surface and the at least one lateral surface, the edge surface faces to the at least one doorjamb and is aligned to the first latching slot, and the at least one lateral surface is configured to slide along the at least one lateral surface and is aligned to the second latching slot; and a latching device embedded within the accommodation slot of the sliding main body, wherein the latching device comprises:

a fixed frame disposed on the sliding main body and received within the accommodation slot, wherein the fixed frame comprises a first side, a second side and a limitation window, the first side and the second side are opposite to each other, and the first side faces to the edge surface;

a first displacement member received within the accommodation slot, disposed on the first side of the fixed frame and slid between a first position and a second position along a first axial direction, wherein the first displacement member comprises at least one through opening and at least one guiding groove;

a first latching member pivotally connected to the fixed frame and comprising a guiding column, wherein at least portion of the guiding column is received within the guiding groove, wherein when the first displacement member is slid to the first position, the guiding column is guided by the guiding groove to rotate the first latching member and at least portion of the first latching member runs through the at least one through opening and protrudes from the edge surface to make the first latching member and the first latching slot be engaged with each other, wherein when the first displacement member is slid to the second position, the guiding column is guided by the guiding groove to rotate the first latching member and the first latching member is received within the at least one through opening;

a second displacement member received within the accommodation slot and adjacent to the first displacement member, wherein the second displacement member is disposed on the first side of the fixed frame and slid between a third position and a fourth position along the first axial direction, and the second displacement member comprises a limitation portion aligned with the limitation window; and a second latching member pivotally connected to the fixed frame and comprising a limitation end running through the limitation window and engaged with the limitation portion, wherein when the second displacement member is slid to the third position, the limitation portion drives the limitation end to rotate the second latching member to be received within the accommodation slot, wherein when the second displacement member is slid to the fourth position, the limitation portion drives the limitation end to rotate the second latching member to protrude at least portion of the second latching member from the at least one lateral surface to make the second latching member and the second latching slot be engaged with each other.

11. The sliding door according to claim 10, wherein the first displacement member comprises a first engagement component and the second displacement member comprises a second engagement component, wherein the first engagement component and the second engagement component are aligned with each other, wherein when the first displacement member is slid to the first position, the first engagement component and the second engagement component are engaged with each other to drive the second displacement member to slid to the third position.

12. The sliding door according to claim 10, wherein the second displacement member comprises an elastic component disposed between the second displacement member and the fixed frame and configured to push against the second displacement member toward the first displacement member, wherein when the first displacement member is slid to the second position, the second displacement member is pushed by the elastic component to slide to the third position and the first engagement component and the second engagement component are engaged with each other.

13. The sliding door according to claim 10, wherein the first displacement member comprises at least one first recess uncovered on the at least one lateral surface of the main body and configured to be driven by a force from a user to slide the first displacement member between the first position and the second position.

14. The sliding door according to claim 13, wherein the second displacement member comprises at least one second recess uncovered on the edge surface of the main body and configured to be driven by a force from a user to slide the second displacement member between the third position and the fourth position.

15. The sliding door according to claim 14, wherein the latching device further comprises a cover body covering the accommodation slot, wherein the cover body comprises at least one first opening, at least one second opening, a third opening and a fourth opening aligned to the at least one through opening, the at least one first recess, the second latching member and the at least one second recess, respectively.

16. The sliding door according to claim 10, wherein the fixed frame comprises at least one first positioning rail disposed on the first side, and the first displacement member comprises at least one first positioning component engaged with the at least one first positioning rail to guide the first displacement member to slide between the first position and the second position along the first axial direction, wherein the fixed frame comprises at least one second positioning rail disposed on the first side, and the second displacement member comprises at least one second positioning component engaged with the at least one second positioning rail to guide the second displacement member to slide between the third position and the fourth position along the first axial direction.

17. The sliding door according to claim 10, wherein the fixed frame comprises a slot opening disposed along the first axial direction, and the first displacement member comprises a positioning column having at least portion received within the slot opening and configured to limit the first displacement member sliding between the first position and the second position along the first axial direction.

18. The sliding door according to claim 17, wherein the first displacement comprises a limitation slot in communication with the at least one through opening, and the latching device further comprises a third latching member pivotally connected to the cover body, wherein the third latching member comprises a limitation column running through the slot opening and at least portion of the limitation column is received within the at least one through opening, wherein when the first displacement member is slid to the first position and the limitation column is aligned to the limitation slot, the third latching member is rotated to drive the limitation column to engage with the limitation slot, and the first displacement member is blocked at the first position.

* * * * *